United States Patent [19]

Johnson

[11] Patent Number: 4,463,528

[45] Date of Patent: Aug. 7, 1984

[54] ARTICULATED AERIAL BOOM AND AN ELBOW LINKAGE ASSEMBLY THEREFORE

[75] Inventor: Leonard L. Johnson, Fort Wayne, Ind.

[73] Assignee: Teco, Inc., Ft. Wayne, Ind.

[21] Appl. No.: 272,986

[22] Filed: Jun. 12, 1981

[51] Int. Cl.[3] ..... B66C 23/62

[52] U.S. Cl. ..... 52/114; 52/115; 52/118

[58] Field of Search ..... 52/111, 114, 115, 116, 52/117, 118; 182/2

[56] References Cited

U.S. PATENT DOCUMENTS

| | | | |
|---|---|---|---|
| 2,881,030 | 4/1959 | Troche | 52/117 X |
| 2,949,741 | 8/1960 | Troche et al. | 52/115 X |
| 3,108,655 | 10/1963 | Troche | 52/114 X |

FOREIGN PATENT DOCUMENTS

| | | | |
|---|---|---|---|
| 1138825 | 1/1969 | United Kingdom | 182/2 |

*Primary Examiner*—John E. Murtagh
*Assistant Examiner*—Kathryn L. Ford
*Attorney, Agent, or Firm*—David A. Lundy

[57] ABSTRACT

An articulated aerial boom and an elbow linkage therefore permitting the proximal end of the upper aerial boom to rotate approximately 210° about the proximal end of a lower aerial boom.

11 Claims, 13 Drawing Figures

ARTICULATED AERIAL BOOM AND AN ELBOW LINKAGE ASSEMBLY THEREFORE

BACKGROUND OF THE INVENTION

This invention pertains to an articulated aerial boom, and more particularly to an improved articulated aerial boom and an improved elbow linkage therefore whereby an upper aerial boom can rotate about 210 degrees about a lower aerial boom allowing a one man, side hung bucket to be raised and manuevered into positions heretofore difficult if not impossible with prior art booms.

Prior to this time, such aerial booms were limited in the degree of rotation of the upper aerial boom about the lower aerial boom. This precluded or made difficult the positioning of the boom and its bucket in various positions.

Additionally, maintenance upon the elbow linkage of such articulated aerial booms was made time consuming and difficult because of the manner in which the upper and lower aerial booms were connected, and the weight and construction of the elbow linkage assembly.

It would therefore be highly desirable to provide an improved articulated aerial boom and elbow linkage which permits a greater degree of rotation of the upper aerial boom about the lower aerial boom.

It would also be highly desirable to provide an improved articulated aerial boom and elbow linkage which would allow repair and maintenance of objects located at elevated, angled positions to be made with ease.

It would be further highly desirable to provide an improved articulated aerial boom and elbow linkage that is light in weight.

It would be still further highly desirable to provide an improved articulated aerial boom and elbow linkage that would allow ease of disassembly for maintenance purposes.

SUMMARY OF THE INVENTION

It is therefore a primary object of the invention to provide an improved articulated aerial boom and an improved elbow linkage assembly therefore.

It is also an object of the invention to provide an improved articulated aerial boom and an improved elbow linkage therefore which permits a greater degree of rotation of the upper aerial boom about the lower aerial boom.

It is also an object of the invention to provide an improved articulated aerial boom and an improved elbow linkage therefore which would allow the repair and maintenance of objects located at elevated, angled positions to be made with ease.

It is another object of the invention to provide an improved articulated aerial boom and an improved elbow linkage therefore that is light in weight.

It is further an object of the invention to provide an improved articulated aerial boom and an improved elbow linkage therefore that would allow ease of disassembly for maintenance purposes.

It is finally an object of the invention to provide an improved articulated aerial boom which fulfills all of the aforementioned objects.

Briefly, what is provided is an articulated aerial boom and an elbow linkage therefore permitting the proximal end of the upper aerial boom to rotate approximately 210 degrees about the proximal end of the lower aerial boom.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

DESCRIPTION OF A SPECIFIC EMBODIMENT

Figure 1:
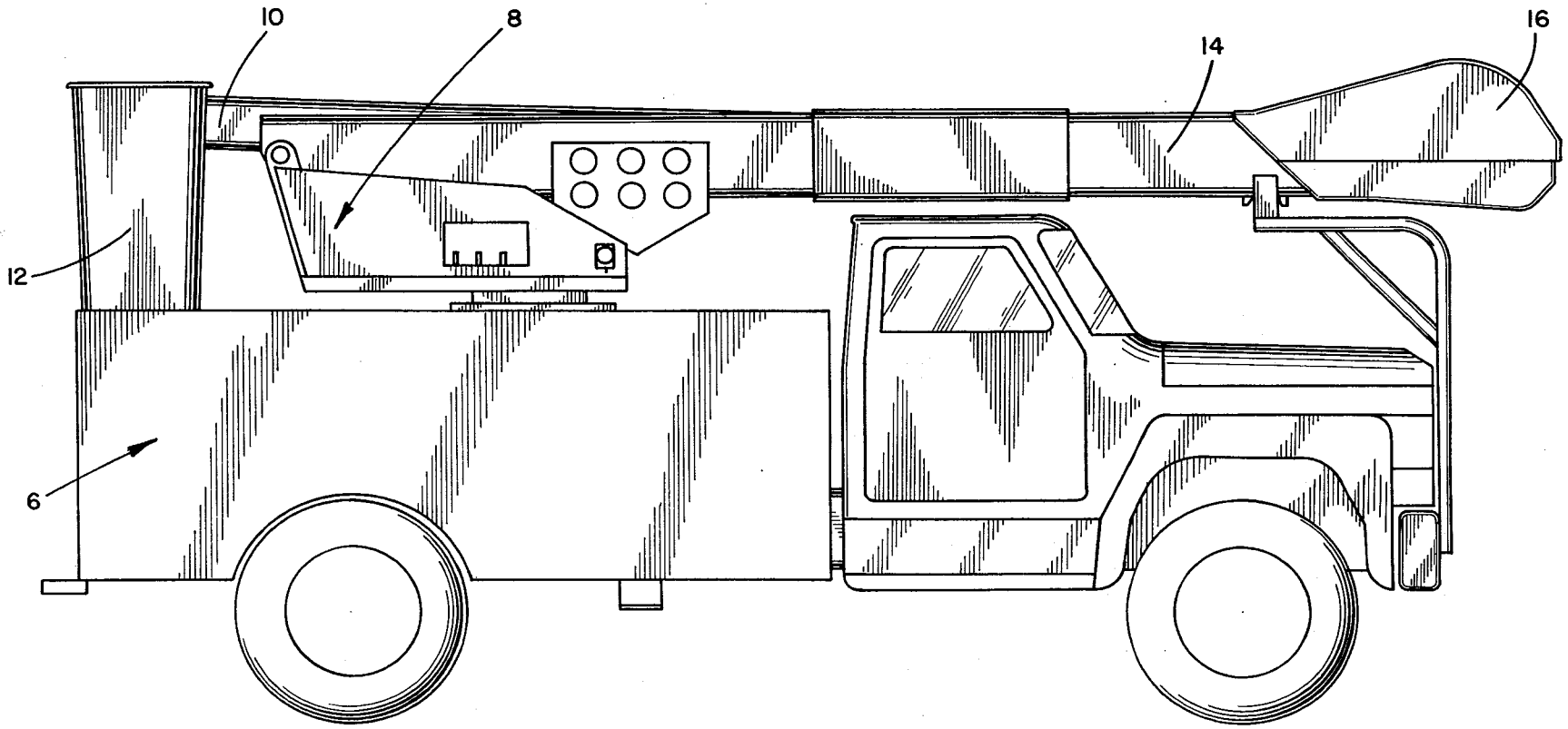
FIG. 1 depicts a right side plan view of a cherry picker with the improved articulated aerial boom in a retracted condition FIG. 2 diagramatically illustrates the approximate 210° rotation of the upper aerial boom about the lower aerial boom of the improved aerial boom of the invention.
Figure 2:
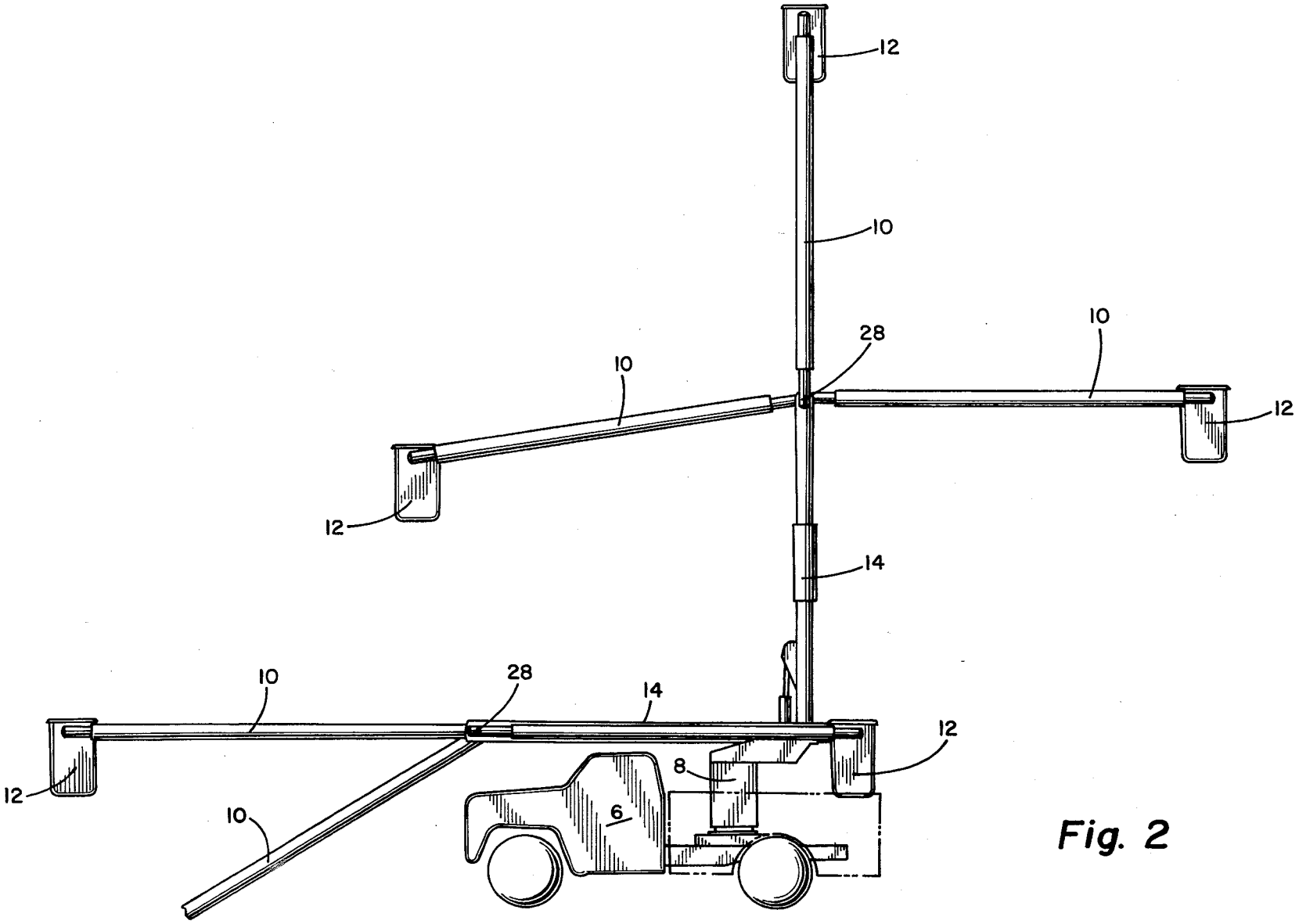
Figure 3:
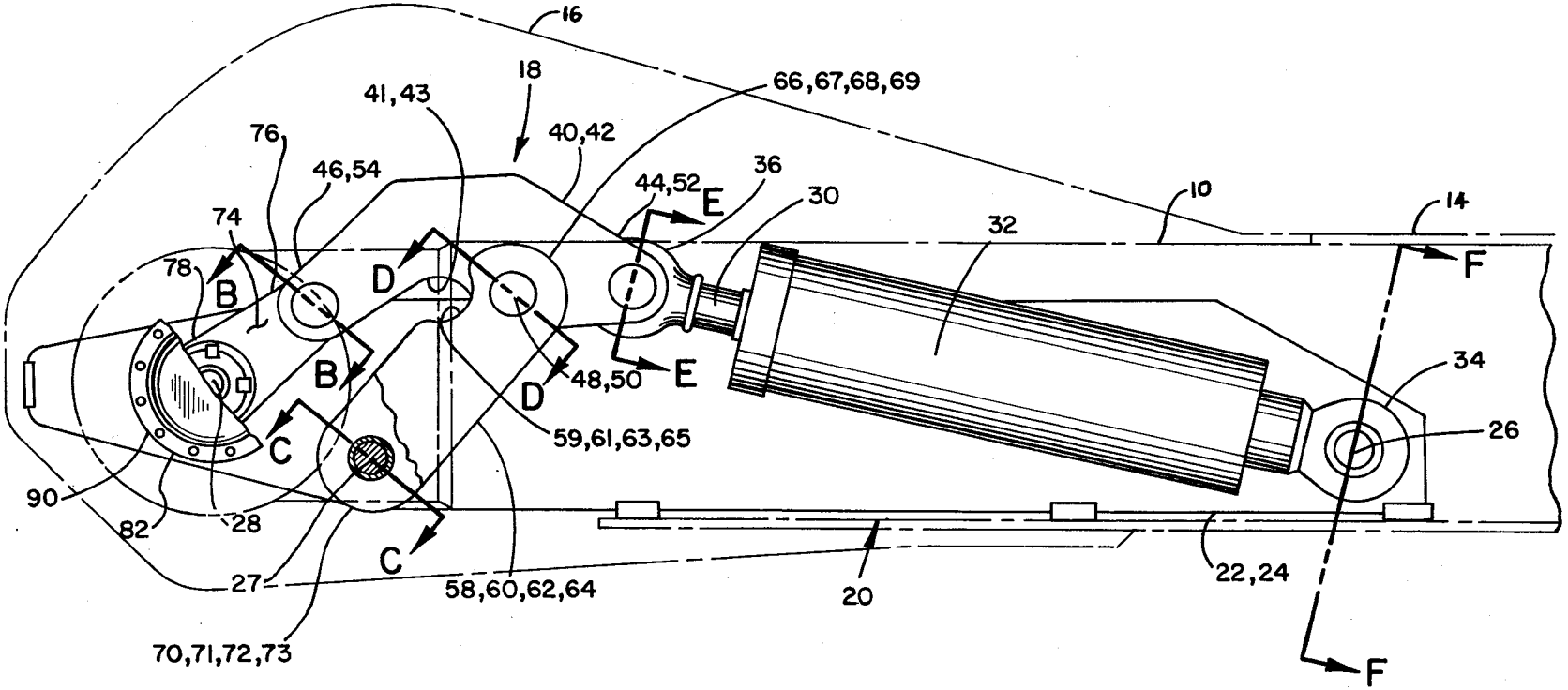
FIG. 3 is a fragmentary, partially cutaway left side plan view of the improved elbow linkage of the aerial boom of the invention showing the upper and lower booms in dashed lines.
Figure 4:
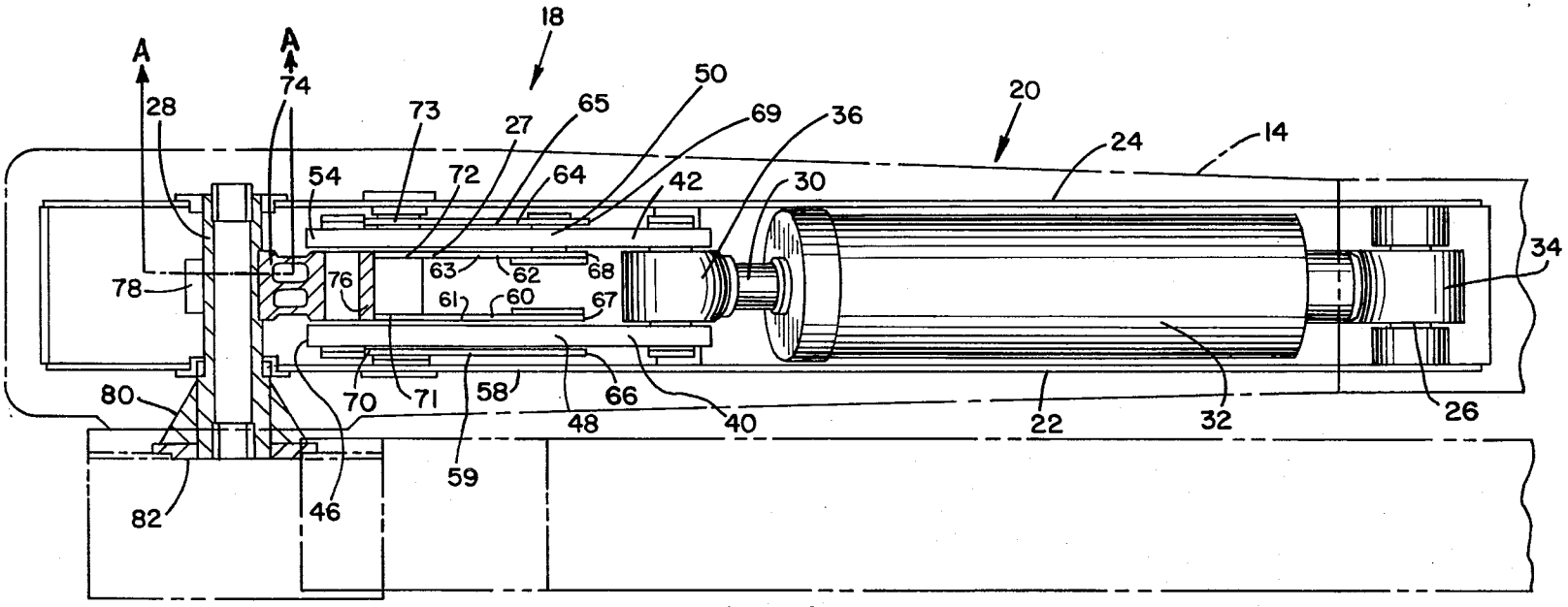
FIG. 4 is a fragmentary, top plan view of the improved elbow linkage of the aerial boom of the invention showing the upper and lower booms in dashed lines.

Referring to FIGS. 1,3 and 4, an upper aerial boom 10 and a lower aerial boom 14 are shown connected at their proximal ends to an elbow linkage 18 encased within an elbow linkage shell 16. Lower boom 14 is mounted on a platform base 8 of a vehicle 6. A one man, side hung bucket 12 is rotatably attached to the distal end of upper aerial boom 10.

Referring now primarily to FIGS. 3A, 3B, 3C, 3 and 4, the elbow linkage 18 is shown rigidly mounted upon a translatable frame 20 which is rigidly, but translatably secured in the upper and proximal end of lower aerial boom 14. Such mounting expedites the removal of elbow linkage 18 for repair and maintenance by allowing the elbow linkage 18 to be easily withdrawn from lower aerial boom 14.

A linkage frame 20 is comprised of a left side 22, a right side 24, an actuating pin 26 and a supporting pin 27 secured thereto, and an operating pin 28.

Pivotably attached to actuating pin 26 is one end 34 of a hydraulic cylinder 32 having an extendable rod 30 with a distal end 36. Actuation of the hydraulic cylinder 32 causes rod 30 to extend or retract as desired.

Figure 5C:
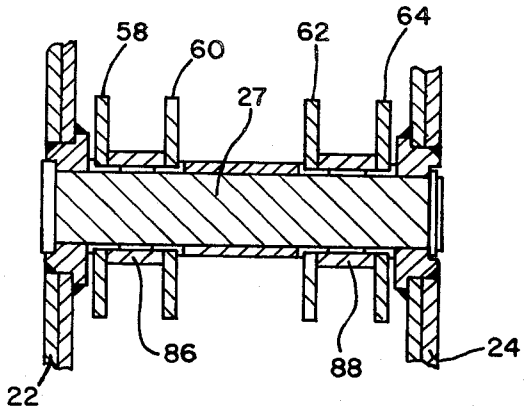
FIG. 5A, 5B, 5C, 5D, 5E, and 5F are cross-sectional views of the connection of the four bar elbow linkage taken substantially along the section lines A—A, B—B, C—C, D—D, E—E, and F—F of FIGS. 3 and 4, respectively.
Figure 5F:
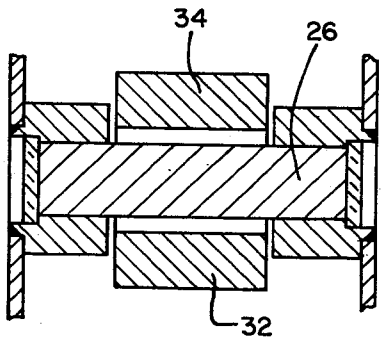
Figure 5B:
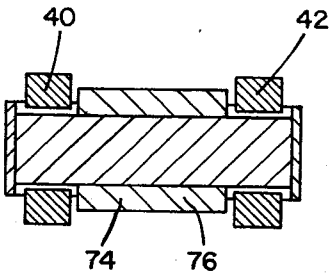
Figure 5E:
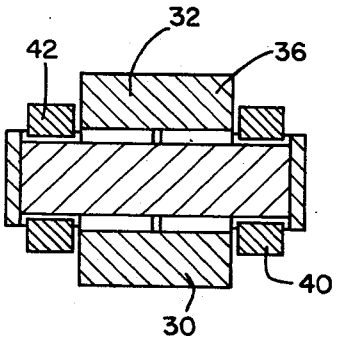
Figure 5A:
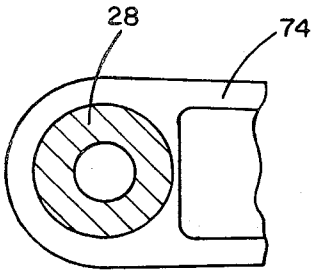
Figure 5D:
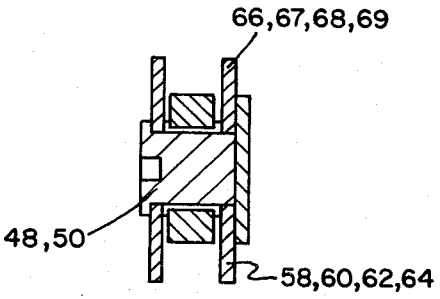

Pivotably and translatably connected to rod end 36 are two connecting bars 40, 42 having concave undersurfaces 41, 43 and opposite ends 44, 52, 52 and 54. Ends 44, 46 of connecting bars 40, 42 are pivotally and translatably attached to opposite sides, respectively, of rod end 36 of actuating rod 30. Pivotally and translatably connected to bars 40, 42 between ends 42, 44, 52 and 54, at positions 48, 50 respectively are support bars 58, 60, 62 and 64. Bars 58, 60, 62 and 64 each have concave upper surfaces 59, 61, 63, 65 and opposite ends 66, 67, 68, 69, 70, 71, 72 and 73. Specifically attached to opposite sides of connecting bar 40 at position 48 are ends 66, 67, respectively, of supporting bars 58, 60 and attached to opposite sides of connecting bar 42 at position 50 are ends 68, 69, respectively, of supporting bars 62 and 64. Pivotably attached to the right end portion of supporting pin 27 of linkage frame 20 are ends 70, 71 of bars 58 and 60. Pivotably attached to the left hand portion of supporting pin 27 of linkage frame 20 are ends 72, 73 of bars 60 and 62. Referring to FIG. 5C, supporting bars 58, 60, 62 and 64 are maintained in a spaced condition and essentially parallel on supporting pin 27 by a right spacer 86 and a left spacer 88. See also FIGS. 5A, 5B, 5D, 5E.

An operating bar 74 has opposite ends 76 and 78. Pivotably and translatably attached to opposite sides of end 76 are ends 54, 46, respectively, of connecting bars 40 and 42. End 78 is secured to operating pin 28 which is journalled in linkage frame 20. Extending a finite distance outward from one side of operating pin 28 is a supporting flange extension 80 to which is rigidly attached a supporting flange 82. Rigidly attached to the supporting flange 82 is upper aerial boom 10.

Figure 3A:
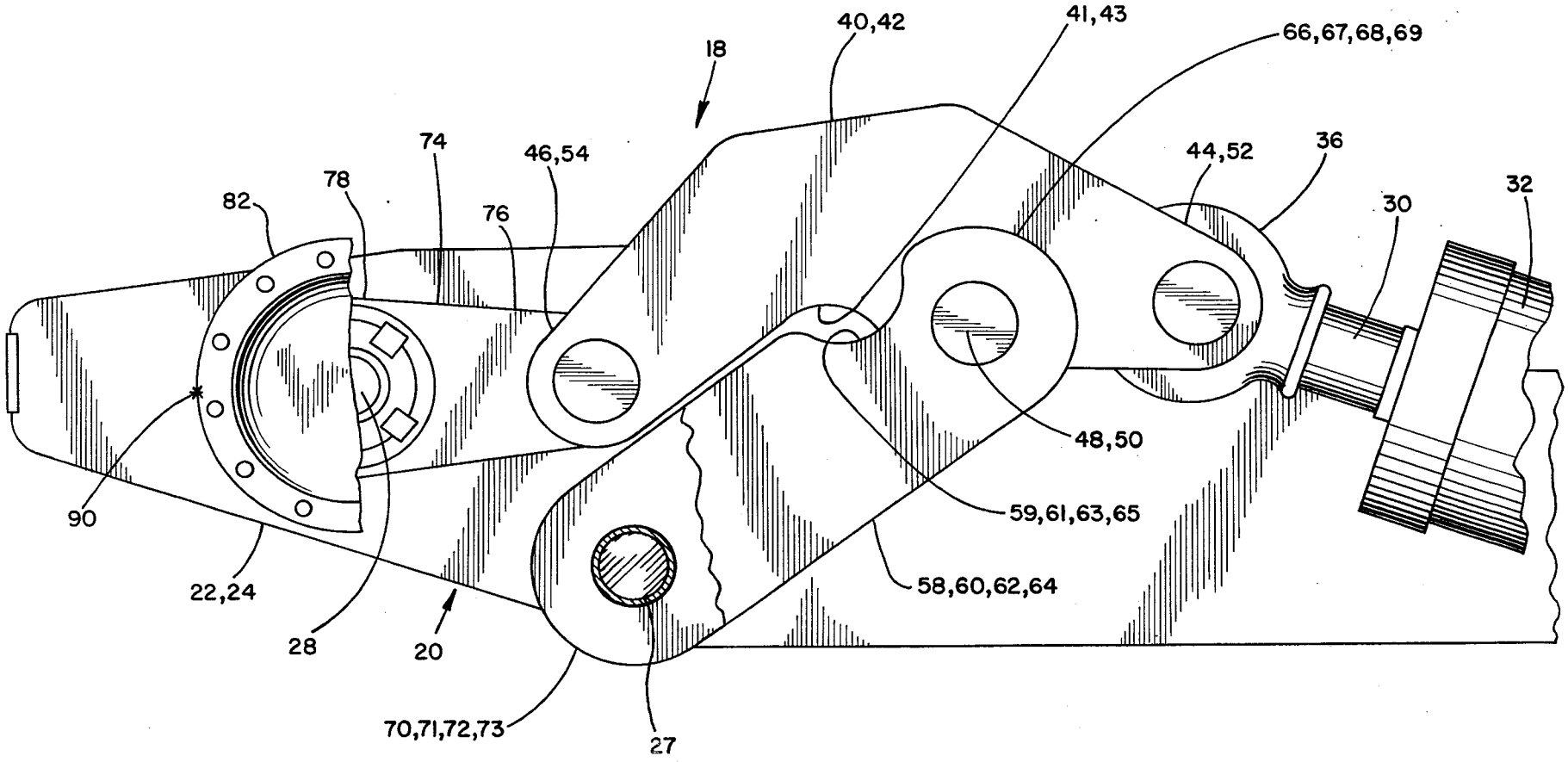
FIG. 3A is a fragmentary, partially cutaway left side plan view depicting the retracted position of the elements of the elbow linkage of the invention.

As shown in FIGS. 3, 3A, 3B, and 3C, the rotation of at least 210° of upper aerial boom 10 about lower aerial boom 14 is made possible by concave undersurfaces 41, 43 of connecting bars 40, 42 and concave uppersurfaces 59, 61, 63, 65 of supporting bars 58, 60, 62, 64. FIG. 3A depicts a point 90 on supporting flange 82 with the four bar elbow linkage 18 at its fully retracted position. As rod 30 of cylinder 32 is extended, cylinder end 34 pivots about actuating pin 26 and end 36 pivots and translates forward and upward and then downward in conjunction with ends 44, 46 of connecting bars 40, 42.

Figure 3B:
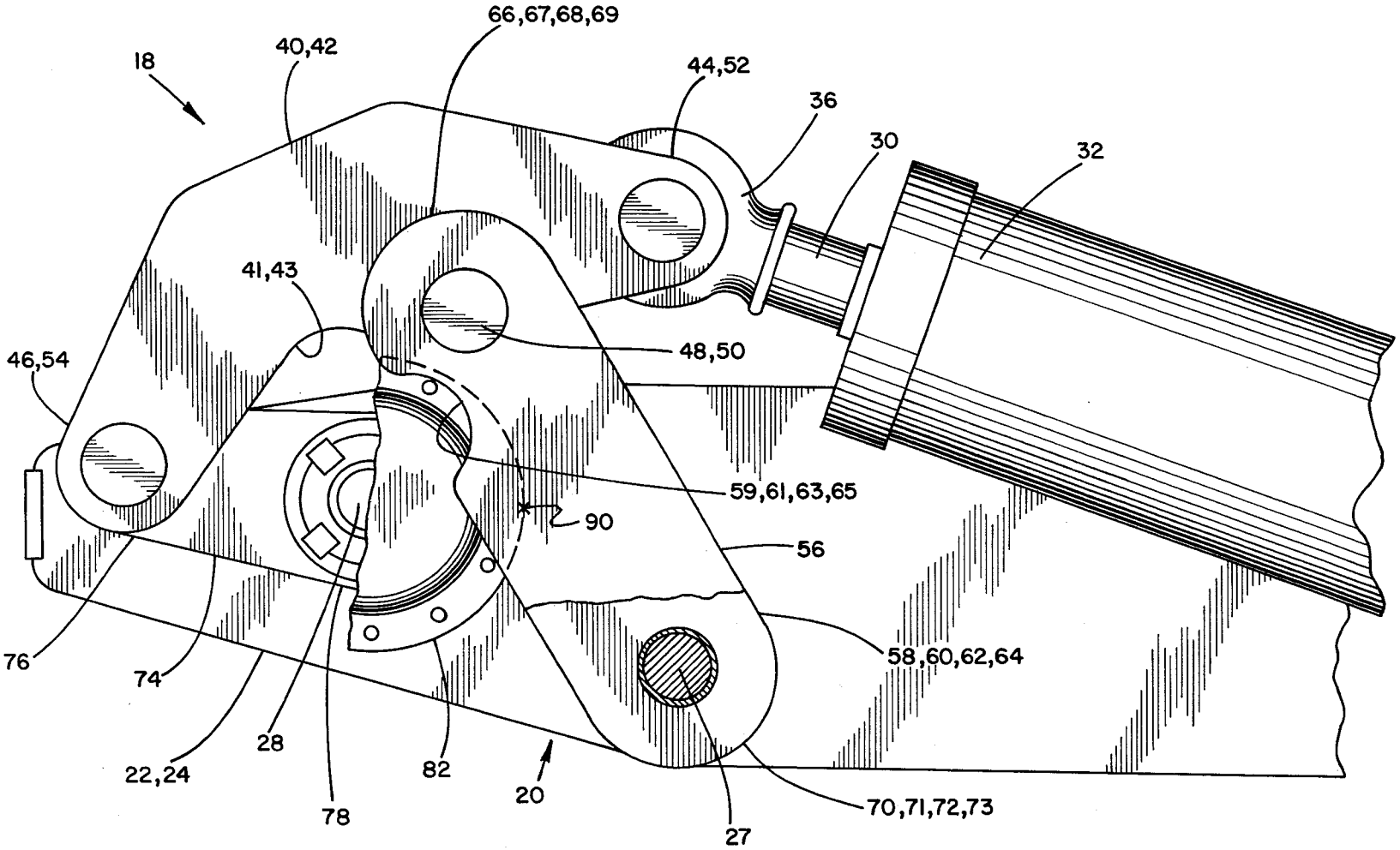
FIG. 3B is a fragmentary partially cutaway left side plan view depicting the position after approximately 180° of rotation of the elements of the elbow linkage of the aerial boom of the invention.

FIG. 3B illustrates the location of point 90 after approximately 180° of rotation of four bar elbow linkage 18, and also depicts the upper most position of connecting bars 40, 42 and supporting bars 58, 60 and as they would appear in a fully rotated position absent concave undersurfaces 41, 43 and concave uppersurfaces 59, 61, 63, 65. The forward and upward and then downward movement of cylinder end 36 is aided and supported by the connections of the eight ends 66, 67, 71, 68, 72, 69, 73, 70 of supporting bars 58, 60, 62 and 64, supporting pin 27, and connecting points 48, 50 of connecting bars 40, 42.

Figure 3C:
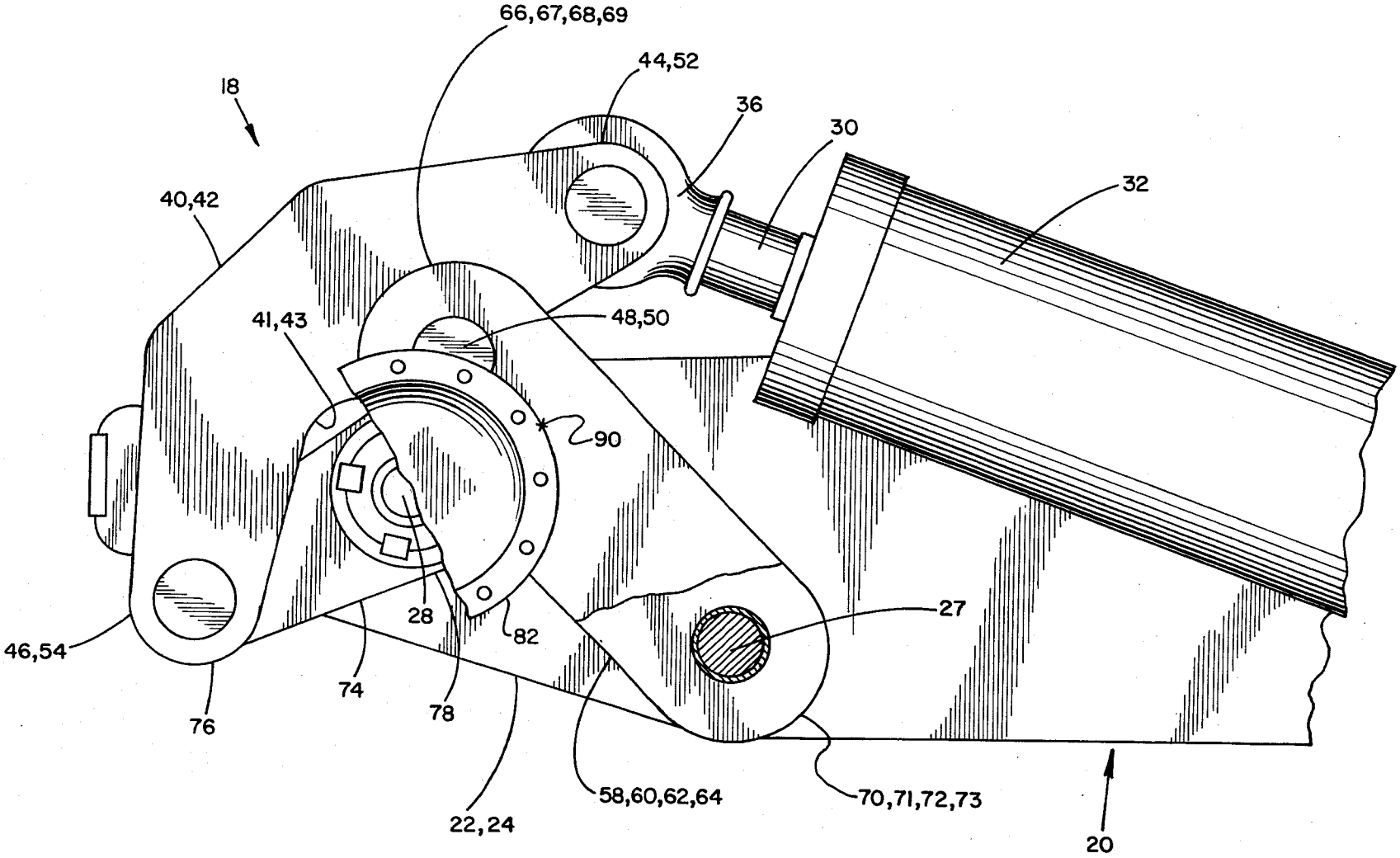
FIG. 3C is a fragmentary, partially cutaway left side plan view depicting the position after approximately 210° of rotation of the elements of the elbow linkage of the aerial boom of the invention.

Further, the downward movement is allowed by concave undersurfaces 41, 43 and concave uppersurfaces 59, 61, 63, 65 rotating towards and being positioned around operating pin 28. It is this concave engagement which permits the rotation of upper aerial boom 10 beyond 180° to at least 210° about lower aerial boom 14. FIG. 3C illustrates the position of point 90 after approximately 210° of rotation of four bar elbow linkage 18, and also shows the positioning of connecting bars 40, 42 and supporting bars 58, 60, 62, 64 with operating pin 28. In other specific embodiments, the concave undersurfaces and concave uppersurfaces may be deeper or shallower than shown, or of different shapes than shown; the concave undersurfaces may be eliminated with the concave uppersurfaces of a depth allowing the desired rotation of boom 10, or the concave uppersurfaces eliminated with the concave undersurfaces of a depth allowing the desired rotation of boom 10.

The forward and upward and then downward movement is then further transferred by a pivotable and translatable connection between ends 46, 54 of connecting bars 40, 42 and end 76 of operating bar whereby end 78 rotates operating pin 28 and rigidly attached flange 82 and upper aerial boom 10 approximately 210° about lower aerial boom 14.

The invention provides an improved articulated aerial boom and an improved elbow linkage therefore which has a greater degree of movement between the upper and lower booms, which is easily disassembled for maintenance purposes and which is relatively light in weight.

While there has been described above the principles of this invention in connection with a specific apparatus, it is to be clearly understood that this description is made only by way of example and not as a limitation to the scope of the invention.

What is claimed is:

1. An articulated aerial boom comprising a platform base, a lower aerial boom having opposite upper and lower ends thereof pivotably mounted at said lower end thereof to said base and having a range of motion of 360° about a generally vertical axis, said lower boom also being movable from a first position generally parallel to said base to a second position generally perpendicular to said base, an upper aerial boom having opposite proximal and distal ends, an elbow linkage interconnected between said proximal end of said upper boom and said upper end of said lower boom, means for removably securing said linkage to said upper and lower booms thereby enhancing removal and replacement of said elbow linkage, said upper and lower booms being movable between a first position thereof in which said upper and lower aerial booms adjoin at said distal and lower ends thereof, respectively, and a second position thereof in which said upper aerial boom defines an angle of at least 210° with said lower aerial boom.

2. The boom of claim 1 wherein said securing means includes an elbow linkage frame, said frame being removably secured to said upper end of said lower boom, an operating pin journalled for rotation in said frame, means for rotating said operating pin, and means for removably securing said proximal end of said upper boom to said operating pin.

3. The boom of claim 2 wherein said rotating means includes a hydraulic cylinder, a plurality of connecting bars, a plurality of support bars and an operating bar each of which has opposite ends, one end of said operating bar being secured to said operating pin, the other end of said operating bar being pivotably connected to one end of said connecting bars, the other ends of said connecting bars being pivotably connected to one end of said hydraulic cylinder, the other end of said hydraulic cylinder being pivotably connected to said frame between said operating pin and the connection of said hydraulic cylinder to said frame, the other end of said supporting bars being pivotably connected to said connecting bars between said opposite ends thereof, at least one of said operating bar and support bars have concave surfaces facing said operating pin whereby upon extension or said hydraulic cylinder said concave surfaces partially surround said operating pin thereby to allow said operating pin to rotate more than 180°.

4. The boom of claim 3 wherein said connecting bars are two in number and connected on opposite sides of said operating bar, and said supporting bars are four in number and are connected on opposite sides of said connecting bars.

5. The boom of claim 3 wherein said operating pin is allowed by said operating bar and support bars to rotate at least 210°.

6. The boom of claim 2 wherein said supporting bars are longer than said operating bar and shorter than said connecting bars and said cylinder.

7. An elbow linkage for connecting upper and lower booms in an articulated aerial boom structure comprising a frame, means for removably securing said frame to the upper end of said lower boom, an operating pin journalled for rotation in said frame, means for securing said operating pin to the proximal end of said upper boom, a hydraulic cylinder, a plurality of connecting bars, a plurality of support bars and an operating bar each of which has opposite ends, one end of said operating bar being secured to said operating pin, the other end of said operating bar being pivotably connected to one end of said connecting bars, the other ends of said connecting bars being pivotably connected to one end of said hydraulic cylinder, the other end of said hydraulic cylinder being pivotably connected to said frame, one end of said supporting bars being pivotably connected to said frame between said operating pin and the connection of said hydraulic cylinder to said frame, the other end of said supporting bars being pivotably connected to said connecting bars between said opposite ends thereof, at least one of said operating bar and support bars each having concave surfaces facing said operating pin whereby upon expansion of said hydraulic cylinder and concave surfaces partially surround said operating pin thereby to allow said operating pin to rotate more than 180°.

8. The linkage of claim 7 wherein said connecting bars are two in number and connected on opposite sides of said operating bar, and said supporting bars are four in number and are connected on opposite sides of said connecting bars.

9. The linkage of claim 7 wherein said operating pin is allowed by said operating bar and support bars to rotate at least 210°.

10. The linkage of claim 7 wherein said supporting bars are longer than said operating bar and shorter than said connecting bars and said cylinder.

11. An elbow linkage for connecting upper and lower booms in an articulated aerial boom structure comprising a frame, means for removably securing said frame to the upper end of said lower boom, an operating pin journalled for rotation in said frame, means for securing said operating pin to the proximal end of said upper boom, a hydraulic cylinder, a plurality of connecting bars, a plurality of support bars and an operating bar each of which has opposite ends, one end of said operating bar being secured to said operating pin, the other end of said operating bar being pivotably connected to one end of said connecting bars, the other ends of said connecting bars being pivotably connected to one end of said hydraulic cylinder, the other end of said hydraulic cylinder being pivotably connected to said frame, one end of said supporting bars being pivotably connected to said frame between said operating pin and the connection of said hydraulic cylinder to said frame, the other end of said supporting bars being pivotably connected to said connecting bars between said opposite ends thereof, said operating bars and support bars each having concave surfaces facing said operating pin whereby upon expansion of said hydraulic cylinder said concave surfaces partially surround said operating pin thereby to allow said operating pin to rotate at least 210°, said connecting bars being two in number and connected on opposite sides of said operating bar, and said supporting bars are four in number and are connected on opposite sides of said connecting bars, said supporting bars being longer than said operating bar and shorter than said connecting bars and said cylinder.

* * * * *